US006532719B2

(12) United States Patent
Hannen et al.

(10) Patent No.: US 6,532,719 B2
(45) Date of Patent: Mar. 18, 2003

(54) SYSTEM FOR WRAPPING LARGE OBJECTS

(75) Inventors: Reiner Hannen, Kalkar (DE); Norbert Vermeulen, Kleve (DE)

(73) Assignee: MSK-Verpackungs-Systeme Gesellschaft mit beschrankter Haftung, Kleve (DE)

( * ) Notice: Subject to any disclaimer, the term of this patent is extended or adjusted under 35 U.S.C. 154(b) by 0 days.

(21) Appl. No.: 09/901,464

(22) Filed: Jul. 9, 2001

(65) Prior Publication Data

US 2002/0007617 A1 Jan. 24, 2002

(30) Foreign Application Priority Data

Jul. 10, 2000 (DE) ..... 200 11 854

(51) Int. Cl.[7] ..... B65B 11/00
(52) U.S. Cl. ..... 53/466; 53/479
(58) Field of Search ..... 53/466, 479, 229, 53/228, 230

(56) References Cited

U.S. PATENT DOCUMENTS 3,672,116 A * 6/1972 Ingmarson ..... 53/229

FOREIGN PATENT DOCUMENTS

| | | |
|---|---|---|
| DE | 1 486 081 | 1/1969 |
| DE | 1 906 575 | 9/1969 |
| DE | 2022577 | 11/1971 |
| DE | 2701506 | 7/1978 |
| DE | 4338810 | 5/1994 |
| DE | 299 92 910 | 5/2000 |
| FR | 2212263 | 7/1974 |
| GB | 2 233 304 | 9/1991 |

OTHER PUBLICATIONS

Derwent Abstract for DE 29902910.*

Derwent Abstract for DE 1906575.*

* cited by examiner

*Primary Examiner*—Ted Kavanaugh

(57) ABSTRACT

A package is wrapped with foil by forming a curtain of two foils pulled from respective supplies with the curtain extending transversely across a conveyor path at a wrapping station and displacing a package to be wrapped in a forward transport direction along the path into engagement with the curtain and through the station so that the foils extend downstream past the package. Then a pair of double-weld beams are moved together on opposite sides of the foils downstream of the station to press and weld the foils together downstream of the package while at the same time the package and beams are relatively displaced in the direction toward each other as the beams are moved together to reduce tension in the foils created by inward movement of the beams.

8 Claims, 5 Drawing Sheets

SYSTEM FOR WRAPPING LARGE OBJECTS

FIELD OF THE INVENTION

The present invention relates to a method of and apparatus for wrapping large objects. More particularly this invention concerns a system for wrapping palletized freight with a shrinkable film.

BACKGROUND OF THE INVENTION

A standard freight-wrapping apparatus has a portal frame, a conveyor extending through the portal frame and having a stretch supporting the package, driven foil-supply rolls whose foils are connected at their ends to form a curtain extending across the portal, and double-weld beams movable together from opposite sides of the portal. The package to be wrapped is conveyed through the portal frame to entrain the curtain so that same wraps around it whereupon the double-weld beams move together to weld the foils together behind the package. It is standard for such an apparatus to use stretch or shrink foils that are then heated to secure them tightly about the package.

A disadvantage of this system is that when the welding beams are moved together to draw the curtain foils together they create additional tension in the foils. This tension can displace the package and/or overstretch the foils. In particular when the package is a stack of cartons stacked on a pallet, the tension in the foil can upset the stack.

OBJECTS OF THE INVENTION

It is therefore an object of the present invention to provide an improved system for wrapping large objects.

Another object is the provision of such an improved system for wrapping large objects which overcomes the above-given disadvantages, that is which wraps the packages without over-tensioning the wrapping material.

SUMMARY OF THE INVENTION

A package is wrapped with foil by forming a curtain of two foils pulled from respective supplies with the curtain extending transversely across a conveyor path at a wrapping station and displacing a package to be wrapped in a forward transport direction along the path into engagement with the curtain and through the station so that the foils extend downstream past the package. Then a pair of double-weld beams are moved together on opposite sides of the foils downstream of the station to press and weld the foils together downstream of the package while at the same time the package and beams are relatively displaced in the direction toward each other as the beams are moved together to reduce tension in the foils created by inward movement of the beams.

Thus with this system the beams are moved downstream or the package is moved upstream in order to prevent the inwardly moving beams from tensioning the foils so much that they break or displace the package. The relative movement in the transport direction takes place during the second half of the movement together of the weld beams, when most tension would be put in the foils. This system ensures that when the package is formed of a stack of even relatively light objects on a pallet, they will not be shifted when wrapped.

The beams according to the invention extend vertically and are displaced transversely of the direction when moved inward toward each other. In addition the beams form a pair of horizontally spaced weld seams in the foils between which the foils are cut to free the package and form a new curtain extending crosswise across the path.

The conveyor can be made with support arms or the like engaging into spaces so that the exterior surfaces of the package are freely accessible for wrapping the package.

The wrapping apparatus according to the invention has a portal frame at a wrapping station, a pair of foil supplies on the frame, feed and looper units associated with the foil supplies for forming a curtain of two foils pulled from the supplies with the curtain extending transversely across the portal frame at a wrapping station. A belt, chain, or beam-type conveyor displaces a package to be wrapped in a forward transport direction along a path extending through the portal frame into engagement with the curtain and through the station so that the foils extend downstream past the package. A pair of double-weld beams at the station are movable transversely of the direction toward and away from each other by a controller. Thus the beams are moved together on opposite sides of the foils downstream of the station to press and weld the foils together downstream of the package while relatively displacing the package and beams in the direction toward each other as the beams are moved together to reduce tension in the foils created by inward movement of the beams.

The controller can displace the package upstream, that is backward in the direction, relative to the beams during movement together of the beams, or can move the beams downstream, that is forward in the direction, to achieve the desired de-tensioning effect. The path according to the invention is horizontal. It could also be vertical with the portal oriented horizontally.

The controller includes a sensor for determining the position of the package relative to the frame. Furthermore the supplies are rolls having center axes and the frame has supports holding the rolls with their axes horizontal. Respective elements deflect the foils into a vertical orientation in the curtain. Respective loopers between the supplies and the curtain, and drive continuously pull the foils from the respective supplies. Thus on changing of the foil rolls a stacker or a hand lift truck can be used since they are delivered on a pallet and are lifted into the apparatus. As a result the expense of handling and likelihood of an accident during changing the foil rolls is reduced. Bearings are provided outside the frame for the axes of the foil rolls.

Here electronic control of the rotation rate of the drives to accommodate the foil as it is used can be eliminated. The rotation rates of the drives is not determined by the instantaneous movements of the apparatus or the transport speed of the packages since the loopers can be constantly refilled and emptied as needed. To this end the foil loopers each have at least one dancer roller.

It is also possible to mount several foil rolls on at least one side of the frame. Thus one foil roll can be a supply roll that is put into service when the other roller is used up. This reduces the down times during foil change. It is also possible to use foil rolls with different foils that can be used as needed. When space is limited the foil rolls can be mounted on one side. In this case the foil is guided from one side over the apparatus.

The system for sensing movement of the double-weld beam can be a rotary pulse generator, an angle detector, or the like for controlling the foil-roll drives so that the drive speed of the foil rolls can be adjusted in dependence on the movement of the arms of the foil supports and deflecting rolls.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
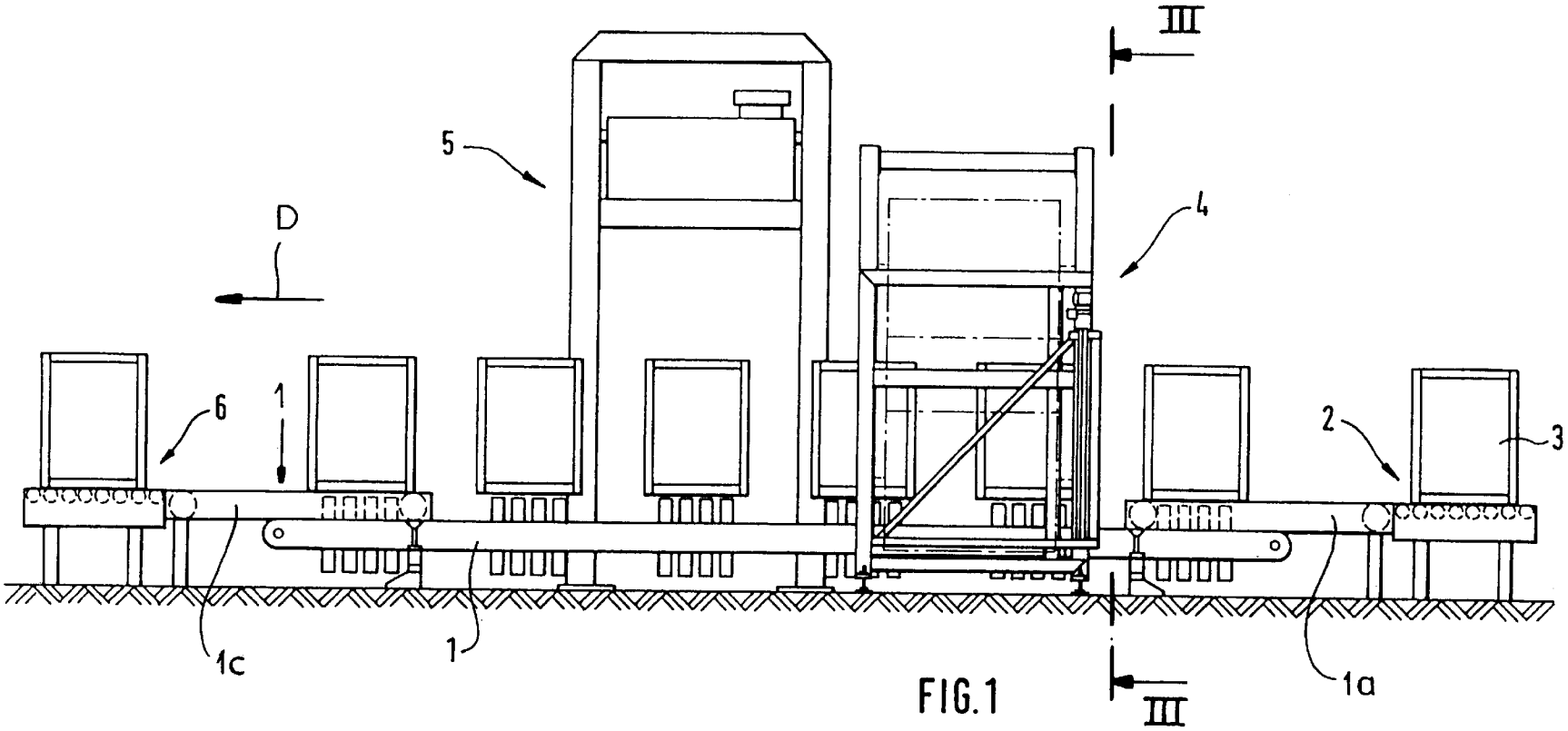
FIGS. 1 and 2 are side and top views of the wrapping apparatus according to the invention.
Figure 2:
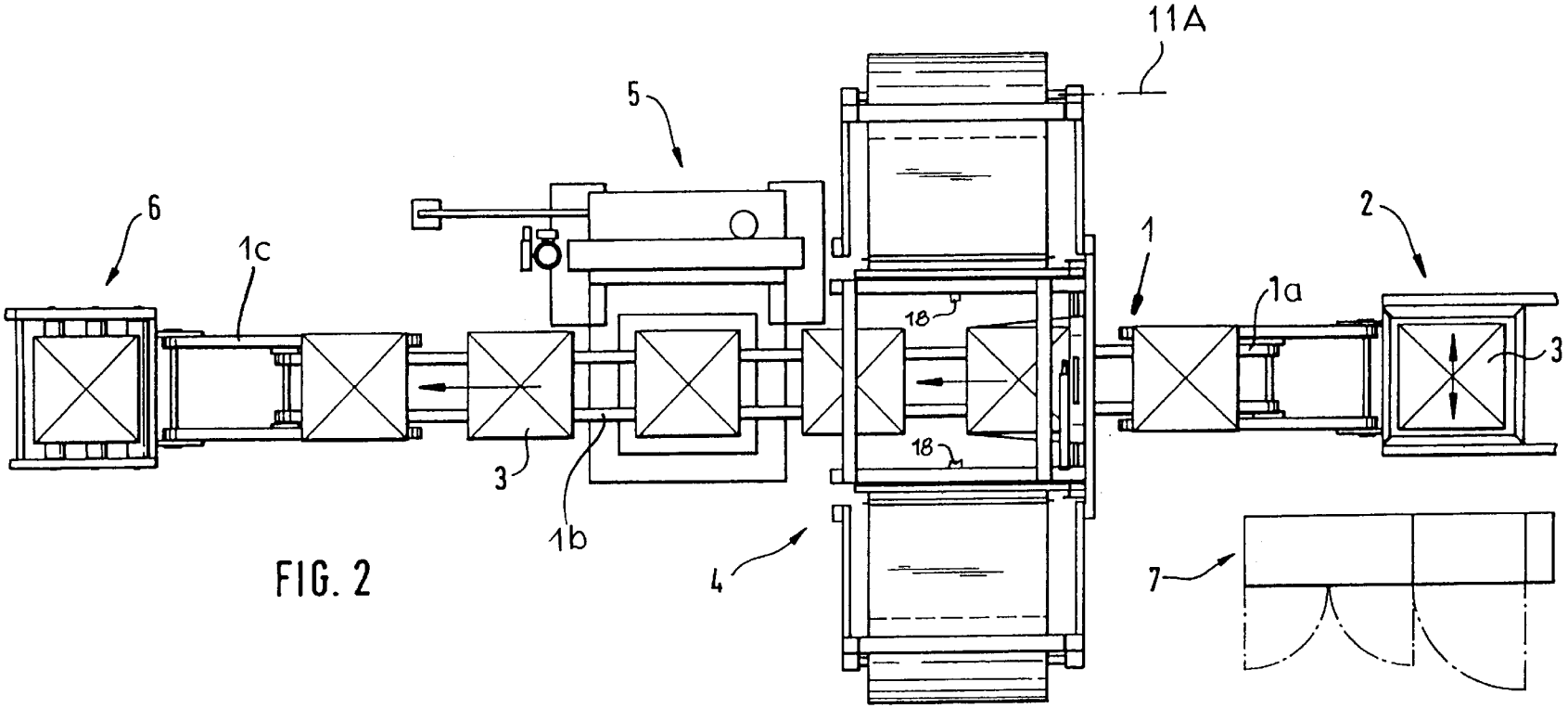

FIGS. 1 and 2 show a conveyor 1 with an intake end 2 for receiving packages 3 that here are palletized stacks of objects. The conveyor 1 extends in a transport direction D from the intake end 2 through a device 4 for wrapping the package with foil and then through a standard shrink device 5 (see U.S. Pat. Nos. 5,018,339, 5,042,235, and 5,11,528) to an output end 6. A controller 7 is provided that can be operated from adjacent the intake end 2. The conveyor 1 can have upstream, central, and downstream portions 1*a,* 1*b,* and 1*c* that operate independently of one other and of which at lest the central portion 1*b* is reversible.

Figure 3:
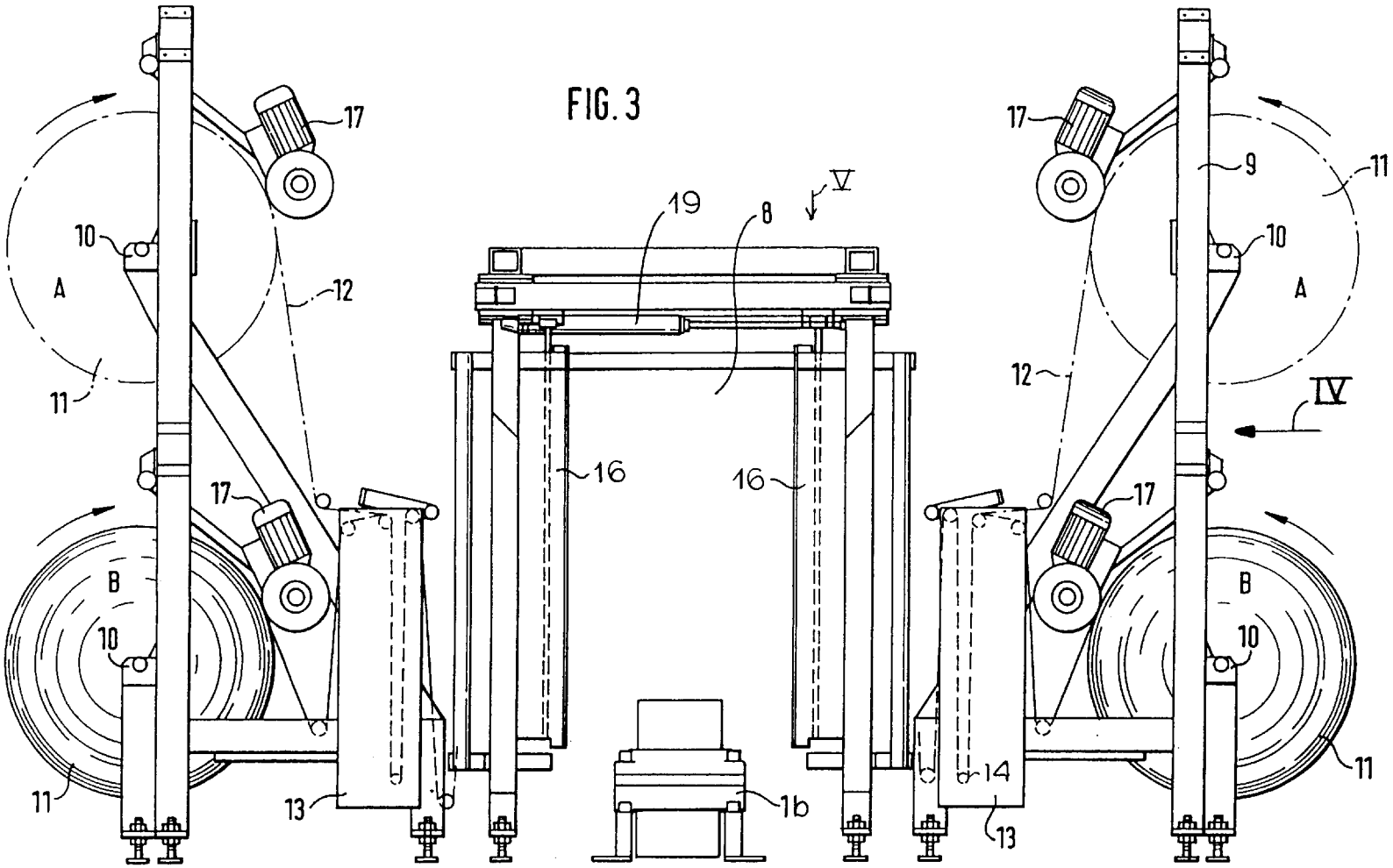
FIG. 3 is a large-scale end view taken generally along line III—III of FIG. 1.
Figure 4:
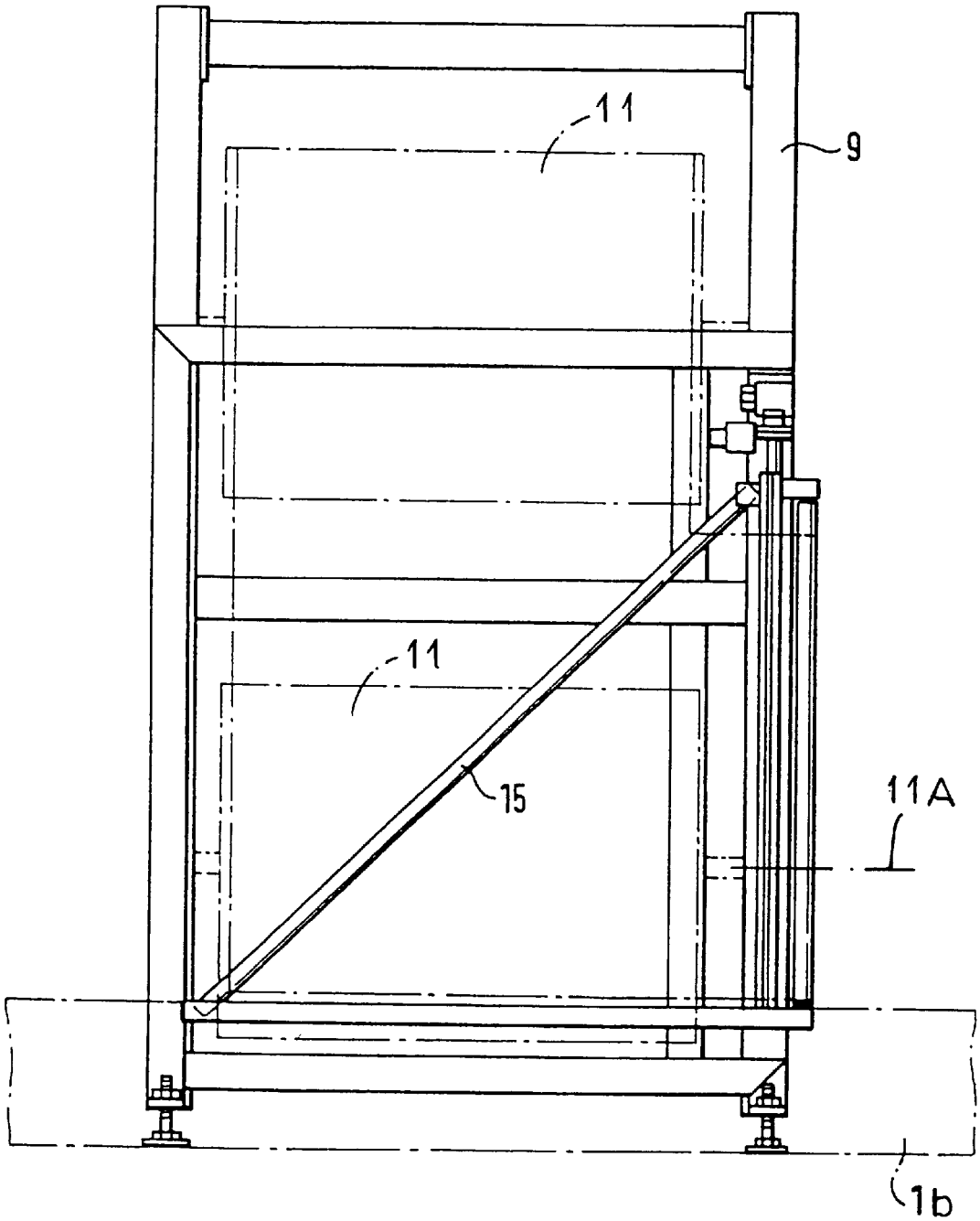
FIG. 4 is a large-scale side view taken in the direction of arrow IV of FIG. 3.
Figure 5:
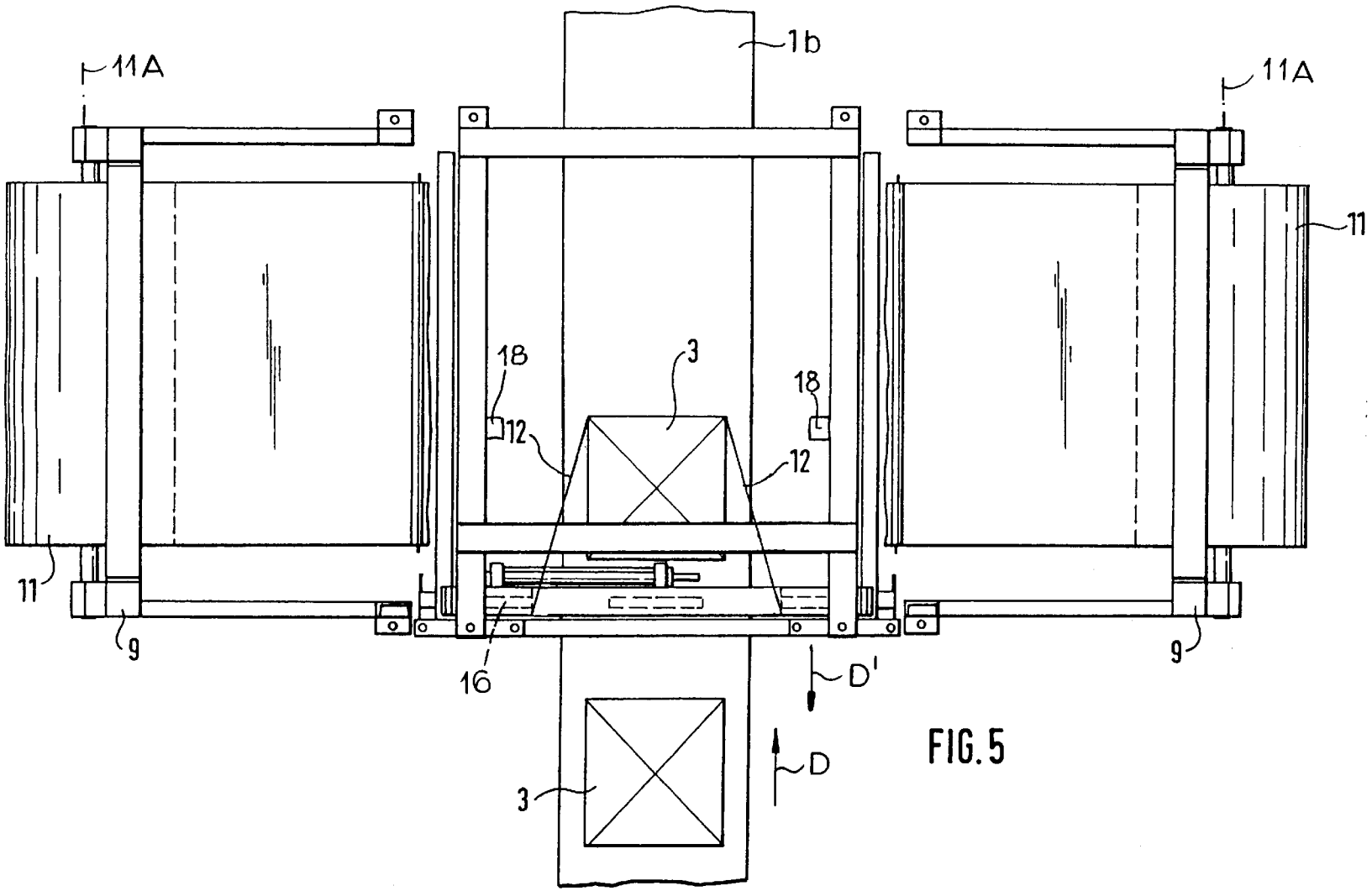
FIG. 5 is a top view taken in the direction of arrow V of FIG. 3.

The wrapping apparatus 4 has, as shown in FIGS. 3 through 5, a portal frame 9 which forms an opening or passage 8 through which the middle section 1*b* of the partially unillustrated conveyor 1 extends. To each side of the portal frame 9 outside the frame 9 is a pair of supports 10 holding horizontally oriented foil rolls 11 not shown for clarity of view in FIG. 4. The two foil rolls 11 have horizontally extending axes 11A. It is also possible to provide only one foil roll 11 on each side.

Foils 12 pulled from the foil rolls 11 extend as shown in FIG. 3 first through respective foil loopers 13 that each have at least one dancer roller 14 and are then passed over deflector rollers 15 that are set at a 45° angle and coated with or completely made of Teflon so as to deflect the foils 12 from a horizontal orientation to a vertical one. In this vertical orientation the two foils 12 come from both sides together and are joined at their free ends in the region of the frame 9.

To this end there is to each side of the portal 8 a double-weld beam 16. The beams 16 can be moved together by respective drives 19 operated by the controller 7. The foil-supply rolls 11 are rotated about their horizontal axes 11A by respective roller drives 17. Furthermore the controller 7 is provided with a sensor that can be a contact switch and/or a light curtain 18 that serves to detect the position of the package 3 relative to the frame 9.

The illustrated apparatus functions as follows:

The connected ends of the two foils 12 form a curtain across the frame 9. The conveyor 1 advances the package 3 in the direction D into this curtain so that the foils 12 wrap around the front and two sides of the package 3. After the package 3 has moved past the beams 16, they move together and pull the foils 12 around the back side of the package until they meet at or near its middle. The foils 12 are there welded together along two seams and are separated between the seams by an unillustrated hot wire so as to form another curtain for the following package 3. The wrapped package 3 then moves downstream to the shrinker 5 where the foils wrapped loosely around it are made snug.

The rub-roller drives 17 of the foil rolls 11 can operate practically without interruption independently of the transport speed of the conveyor 1 and the cycling of the apparatus so that foils 12 are continuously fed into the respective foil loopers 13. The foils 12 in the loopers 13 are pulled out as needed, that is when a new package 3 is moved into the frame 9 and entrains the foil curtain formed there.

When a foil roll 11 is used up the other foil roll 11 can be put in service without first changing the used-up roll 11. The foil-supply rolls 11 on each side of the frame 9 can have different widths of foil so as to be able to change foil format rapidly.

It is also possible but not shown in the drawing to provide a second foil curtain that is moved upward when not needed. The upward movement creates a difference in path length from the curtain to the supply rolls 11 that can be compensated for by the dancer rollers 14 in the foil loopers 13. This second foil curtain can also be set to overlap the first foil curtain when packages 3 must be wrapped whose heights are larger than the width of the supply foils 12. In this case the deflectors 14 and 15 are vertically adjustable and the foil loopers 13 compensate for the change in path length. Thus only one pair of foil rollers 11 can be movable, although it is also possible for several pairs of foil rollers 11 to be movable.

According to the invention, in order to maintain the tension of the curtain constant, the conveyor 1 is moved backward against the normal transport direction through the portal frame 9 during at least the second half or the movement together of the double-weld beams 16 so that the package is moved backward, closer to the double-weld beams 16. In order to avoid a collision of the package with the double-weld beams 16, the position of the package 3 is determined by the sensor 18 and the controller 7 stops backward movement of the conveyor 1 before the package 3 has been moved backward too far. Alternately the beams 16 can be moved back upstream as indicated by arrow D' in FIG. 5.

The movement of the foil and deflecting rollers can be detected by a device for establishing the position of the double-weld beam 16, in particular a rotary pulse generator, an angle detector, or the like to determine and control the speed of the foil rolls 11.

We claim:

1. A method of wrapping a package with foil, the method comprising the steps of:

a) forming a curtain of two foils pulled from respective supplies with the curtain extending transversely across a conveyor path at a wrapping station;

b) displacing a package to be wrapped in a forward transport direction along the path into engagement with the curtain and through the station so that the foils extend downstream past the package; and c) simultaneously moving together a pair of double-weld beams on opposite sides of the foils downstream of the station to press and weld the foils together downstream of the package and displacing the package in a reverse direction opposite to the forward direction toward beams to reduce tension in the foils created by inward movement of the beams.

2. The package-wrapping method defined in claim 1 wherein the beams extend vertically and are displaced transversely of the direction when moved inward toward each other.

3. The package-wrapping method defined in claim 1 wherein the beams form a pair of horizontally spaced weld seams in the foils, the method further comprising the step after step c) of e) cutting the foils between the seams to free the package and form a new curtain extending crosswise across the path.

4. A method of wrapping a package with foil using an apparatus having:

a portal frame at a wrapping station;

a pair of foil supplies on the frame; and a pair of double-weld beams at the station movable transversely of a forward transport direction toward and away from each other, the method comprising the steps of:

pulling foils from the respective supplies and forming a curtain of the two foils pulled from the supplies with the curtain extending transversely of the direction across the portal frame at the wrapping station;

displacing a package to be wrapped in the forward transport direction along a path extending through the portal frame into engagement with the curtain and through the station so that the foils extend downstream past the package; and simultaneously moving together the beams on opposite sides of the foils downstream of the station to press and weld the foils together downstream of the package while displacing the package in a reverse direction opposite to the forward direction toward the beams to reduce tension in the foils created by inward movement of the beams.

5. The method defined in claim 4 wherein the path is horizontal.

6. The method defined in claim 4, further comprising the step of determining the position of the package relative to the frame.

7. The method defined in claim 4 wherein the supplies are rolls having center axes, the frame having a support holding the rolls with their axes horizontal, the method further comprising the step of deflecting the foils into a vertical orientation in the curtain.

8. The method defined in claim 4, further comprising the steps of looping the foils between the supplies and the curtain; and continuously pulling the foils from the respective supplies.

* * * * *